United States Patent [19]

Preuss et al.

[11] 4,092,022

[45] May 30, 1978

[54] SIDE-REGISTERING DEVICE

[75] Inventors: Friedrich Preuss, Sprendlingen; Kurt Difflipp, Dietzenbach, both of Germany

[73] Assignee: Roland Offsetmaschinenfabrik Faber & Schleicher AG., Germany

[21] Appl. No.: 801,312

[22] Filed: May 27, 1977

[30] Foreign Application Priority Data

May 29, 1976 Germany ..... 2624170

[51] Int. Cl.[2] ..... B65H 9/00

[52] U.S. Cl. ..... 271/236; 271/252

[58] Field of Search ..... 271/228, 230, 236, 237, 271/238, 250, 252

[56] References Cited

U.S. PATENT DOCUMENTS

| | | | |
|---|---|---|---|
| 2,984,483 | 5/1961 | Kist | 271/237 |
| 3,593,989 | 7/1971 | Crittenden | 271/238 |

*Primary Examiner*—Richard A. Schacher

*Attorney, Agent, or Firm*—Leydig, Voit, Osann, Mayer & Holt, Ltd.

[57] ABSTRACT

A device for the lateral and longitudinal positioning of sheets on the feed table of a printing press, with the leading edge of the sheet engaging a set of front stops and the lateral edge of the sheet in contact with a side guide, enabling accurate registered pick up by a transfer cylinder or the like. Cooperating laterally swingable wiper members are provided both above and below the sheet having friction shoes for wiping the sheet in the direction of the side guide. The friction shoes are connected to the respective wiper members in such a way as to provide freedom of relative movement at right angles to the direction of wipe so that the sheet may move against the front stops at the same time that is being wiped toward the side guide. In the preferred embodiment of the invention the wiper members are in the form of synchronously rotated arms timed so that the arms engage the sheet as the sheet approaches the front stops, and the friction shoes are in the form of rollers interposed at the ends of the arms, freely rotatable about axes which extend in the direction of wiping movement, so that the sheet may complete its movement against the front stops, with accommodating rotation of the rollers, as it is being urged by the rollers toward the side guide. In an alternative embodiment the friction shoes are stiffly secured to the wiping members in the wiping direction but supported with light resilient force in the direction of movement of the sheet so as to permit final movement of the sheet simultaneously in the two directions.

18 Claims, 6 Drawing Figures

SIDE-REGISTERING DEVICE

In a sheet fed press, sheets are fed in quick succession across a feed table into a longitudinally and laterally registered position from which each sheet is picked up and transferred into contact with the printing cylinders. Multicolor printing is particularly exacting, requiring that each sheet be in a precisely controlled position of accurate register during a series of printing impressions.

Theoretically accurate register in the longitudinal direction may be achieved by causing the leading edge of the sheet to engage a set of front stops, while various mechanisms have been employed to secure lateral register. For example, in German Pat. No. 271,987 lateral register is secured by a driven conveyor tape which engages the underside of the sheet to urge it in the lateral direction. In German Pat. No. 292,137 an oscillating cam engages the top side of the sheet for lateral wiping movement. In both cases a cooperating "clamping" element is used which may be in the form of a stationary plate or which may be movable with the wiping member.

An inherent disadvantage of conventional side-registering devices is that the sheet, when undergoing lateral movement, is more or less positively engaged so that the sheet has not been able to move forwardly, into engagement with the front stops, at the same time that it is being moved laterally. The problem has been made more acute in recent years by use of higher and higher press speeds so that the time allowed for final register becomes so short that registration accuracy is severly impaired. This is especially true using certain grades of paper.

It is, accordingly, an object of the present invention to provide a side-registering device consisting of a wiping member having a friction shoe thereon which is so constructed and arranged as to permit continued longitudinal movement of the sheet against the front stops notwithstanding the wiping movement of the sheet toward the side guide. It is, in other words, an object of the present invention to provide a side-registering mechanism in which final registering movement can take place simultaneously in the longitudinal and lateral directions at right angles to one another.

It is another object of the present invention to provide means for achieving concurrent longitudinal and lateral register in the shortest possible period of time, thereby ensuring achievement of an accurately registered condition in presses which are operable at the highest commercial speeds.

It is a related object of the invention to provide cooperating longitudinal and lateral registering means in which the timing of the lateral register, as related to the longitudinal position of the sheet, is relatively non-critical, even at high speed, and which, once timed, requires no further or touch-up adjustment even in long press runs.

It is yet another object of the invention to provide a side-registering device which is inherently accurate and largely foolproof over a wide range of speed and over a wide range of available sheet material, ranging all of the way from board stock to flimsy tissue.

It is a more specific object of the invention to make use of a friction shoe in the form of a crowned roller mounted upon a swingable arm, the axis of the arm being arranged longitudinally while the roller axis is arranged transversely thereto to permit free movement of the sheet toward the front stops at the same time that the roller is wiped sideways, in the lateral direction, against the sheet.

It is a further object if the invention to provide a side-registering device which achieves a maximum of head room for the sheet but which operates in a smooth and quiet fashion.

It is yet another object of the invention to provide a side-registering device which is highly economical in construction, which requires little or no maintenance, and which is adaptable to both new and existing side-register constructions with relatively minor modification or addition.

Other objects and advantages of the invention will become apparent upon reading attached detailed description and upon reference to the drawing in which.

While the invention has been described in connection with certain preferred embodiments, it is understood that we do not intend to be limited by the particular embodiments shown but intend to cover the various alternative and equivalent forms of the invention included with the spirit and scope of the appended claims.

Figure 1:
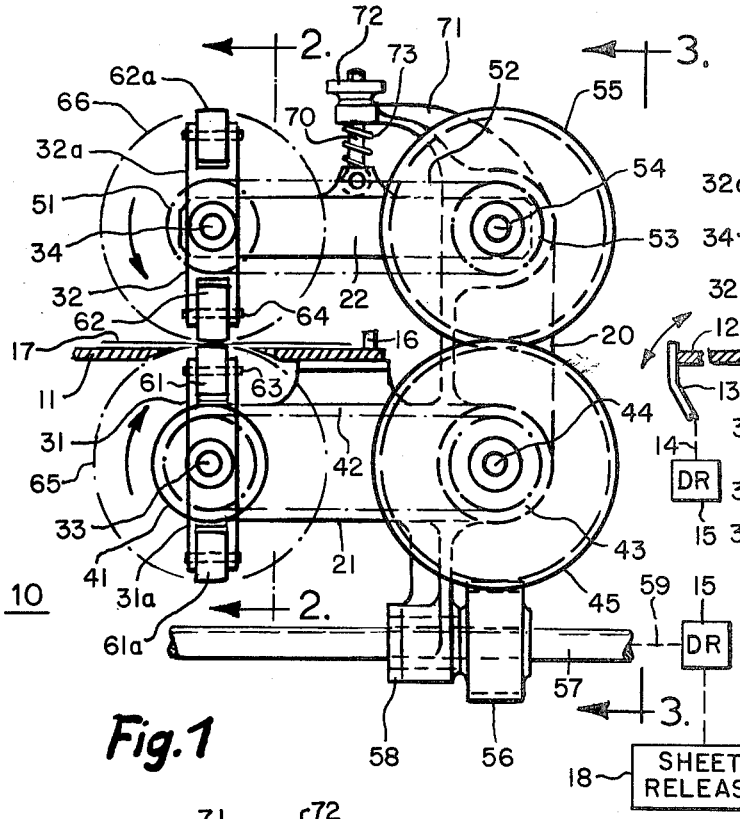
FIG. 1 is a side elevation of a side-registering device looking upstream of the direction of sheet movement.
Figure 2:
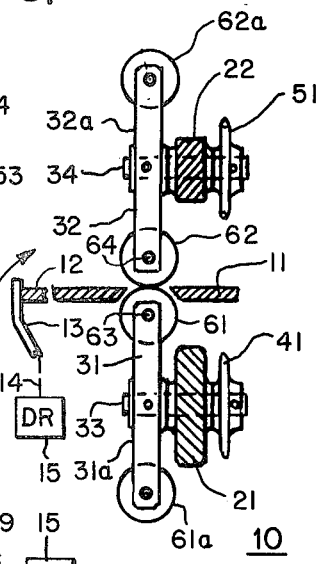
FIG. 2 is a vertical section looking along line 2—2 in FIG. 1.
Figure 3:
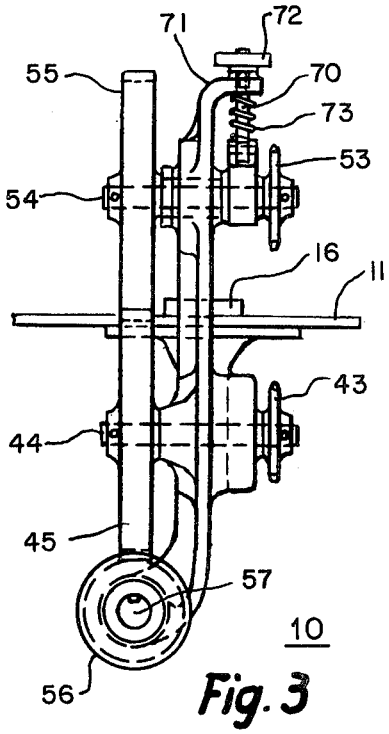
FIG. 3 is a right-hand end view looking along line 3—3 in FIG. 1.

Referring now to the drawing, a side-registering device 10 constructed in accordance with the invention is mounted adjacent the left hand edge of a feed table 11 having a front edge 12 and a cooperating set of front stops 13. The latter have a connection 14 with the press drive diagrammatically illustrated at 15, with the stops 13 being cyclically interposeable by the drive synchronized with the arrival of a sheet, as well understood in the art. At the left hand side of the table 11 (right hand side as viewed in FIG. 1) is a side guide 16 for engaging the lateral edge of the sheet. Thus when a sheet, indicated at 17, is fed across the feed table 11 by transport and releasing means indicated generally at 18, the front edge of the sheet is engaged by the front stops 13, following which the stops are moved out of the way and the sheet is conveyed into the press by conventional transfer means (not shown).

For the purpose of ensuring precise lateral register of the sheet, the side-registering device 10 includes means for wipingly engaging the sheet for moving it laterally against the side guide 16. The device 10 has a frame 20 mounting a lower bracket 21 which extends under the sheet and an upper bracket 22 which overlies the sheet. These brackets at their remote ends carry lower and upper cooperating wiper members in the form of arms 31, 32. The wiper members are mounted for swinging, that is, rotational, movement about respective shafts 33, 34 having axes which are alined in a substantially vertical plane.

For the purpose of rotating the arms 31, 32 in unison so that they cooperate with one another to apply lateral wiping movement to a sheet, the arms are connected via individual sprocket chains, to meshed gears which are, in turn, coupled to the press drive. Focusing attention upon the lower assembly, the shaft 33 is connected to a driven sprocket 41 which is coupled, by a chain 42, to a drive sprocket 43 on a shaft 44 which is journalled in the frame, the shaft being driven by a gear 45. Similarly, the shaft 34 in the upper assembly has a driven sprocket 51 which is coupled by a chain 52 to a drive sprocket 53 on an upper shaft 54, the latter being driven by gear 55 which is meshed with the lower gear 45. The two gears 45, 55 are preferably of the helical type, driven by helical pinion 56 on a drive shaft 57 journaled in a depending bracket 58. The drive shaft is coupled by a connection 59 to the press drive 15 with such phasing that a typical sheet 17 is engaged for wiping movement by the arms 31, 32 as the sheet moves longitudinally along the table into the vicinity of the front stops 13.

In accordance with the present invention the wiping members 31, 32 are provided with friction shoes for engagement with the presented lower and upper surfaces of a sheet, the friction shoes being in the form of rollers freely rotatable about axes which extend in the direction of wiping movement so that the sheet may move against the front stops, with accommodating rotation of the rollers, at the same time that it is being wiped by the rollers toward the side guide. Thus the arm 31 has a roller 61 and the arm 32 a roller 62, freely rotatable about pins 63, 64. These pins will be seen to extend, during the active wiping movement, in the direction of such wiping movement, that is, in the direction of the side guide 16 as is evident in FIG. 1.

The rollers are preferably crowned to coincide with the envelopes of swinging movement, such envelopes being indicated by the dot-dash lines 65, 66. The width of the rollers is determined by the length of the wiping stroke which is desired.

It will be apparent, then, that as a typical sheet 17 is propelled along the surface of the feed table 11 into the vicinity of the front stops 13, the rollers will travel from a mutually sheet-engaging position which is spaced from the side guide (to the left as viewed in FIG. 1) to a mutually sheet-releasing position which is adjacent the side guide and with the sheet, during the period of engagement, being "wiped" in the direction of the side guide, at the same time that the sheet completes its longitudinal movement toward, and into contact with, the front stops, the longitudinal movement being accommodated by the free rotation of the rollers.

For the purpose of adjusting the device for different thicknesses of sheet, varying all the way from board stock to tissue paper, the upper bracket 22 is made swingable in a vertical plane about its region of anchoring to the frame 20; more specifically, the upper bracket is pivoted for rocking movement about the shaft 54 which penetrates the sprocket 53 and gear 55. To hold the upper bracket resiliently in an adjusted position, the bracket has an adjusting screw 70 which is received in a goose neck 71 on the frame and onto which is threaded a knurled adjusting nut 72. A compression spring 73 is interposed between the bracket and the goose neck. Thus the bracket may be adjusted upwardly or downwardly by turning the nut 72 in one direction or the other. Because of the spring, any interference between the two arms 31, 32 as they approach dead center, for example resulting from the use of stock of excess thickness, will simply result in the upward camming of the upper bracket against the restoring force of the spring, thereby protecting the entire assembly against the effect of misadjustment.

It is one of the further features of the construction that the arms and rollers are provided in multiple. Thus, in the preferred form of the invention, the arm 31 and its roller 61 are duplicated in diametrical position as indicated at 31*a*, 61*a*. Similarly the arm 32, and roller 62, are duplicated diametrically at 32*a*, 62*a*. As a result each arm acts only on alternate sheets, and the arms may be rotated, for the same sheet feed rate, at half the angular speed.

While the invention has been described in connection with sprocket wheels and sprockets chains, it will be understood that the term "sprocket" as used herewith is intended to cover any substitute flexible driving means as, for example, fabric-reinforced rubber belts on the "cog" or "timing" variety.

ALTERNATE EMBODIMENT

Figure 4:
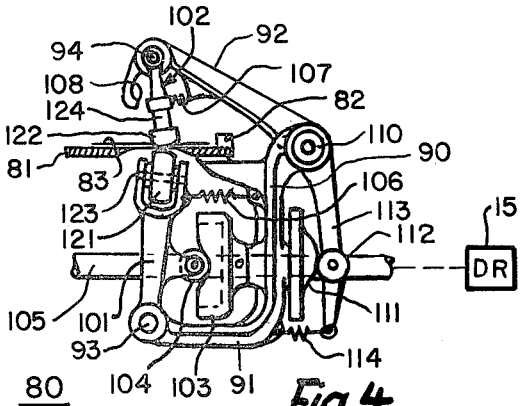
FIG. 4 is a side view taken similarily to FIG. 1 but showing a modified form of the invention.

While the invention has been described above in connection with a preferred embodiment in which the wiping members are continuously rotated in unison, the invention is not limited thereto and includes structures in which the wiping members are oscillated in unison to perform their wiping function. Referring to FIG. 4, the side-registering mechanism generally indicated at 80 is used with a feed table 81 having a side guide 82 and equipped with front stops (not shown) along its front edge for engaging a sheet 83.

Mounted outboard of the side guide is a frame 90 which includes a lower bracket 91 and which mounts an upper bracket 92. At the outer end of the lower bracket is a pivot 93, while the outer end of the upper bracket has a pivot 94.

Secured to the pivots are lower and upper wiper arms 101, 102 respectively. For oscillating the lower wiper arm 101 back and forth, a circular cam 103 is used which engages a cam follower 104 secured to the side of the arm, the cam being driven by a drive shaft 105 which is coupled to the press drive. With the cam 103 faced as shown, the wiper arm 101 receives a power stroke to the left. A tension spring 106 is provided for returning the wiper arm 101 to the right and thereby executing a wiping stroke.

The mechanism shown in FIG. 4 differs from that described earlier in a number of respects but primarily in that only one of the wiper arms is directly coupled to the drive shaft. The other arm, in this case the arm 102, which performs a back-up function, is oscillated by reason of its frictional engagement with the sheet during the wiping stroke. A compression spring 107 is provided to secure return of the arm 102 to its normal, or left hand, position where it rests against a stop 108 which forms an extension of the bracket 92.

For the purpose of mutually engaging the wiper arms with the sheet during the wiping stroke and for disengaging them during the return stroke, means are provided for bringing the wiper arms cyclicly toward and away from one another. This is accomplished in the construction of FIG. 4 by moving the upper pivot point 94 downwardly timed with the beginning of a wiping stroke and for retracting the pivot point upwardly during the return stroke. This is done by pivoting the upper bracket 92 to the frame 90 at a central pivot 110 and by causing the bracket to rock vertically in phase with rotation of the drive shaft 105. Such rocking is brought about by use of a second cam 111 which is rotated by the drive shaft 105 and which has a cam follower 112 which is secured to an arm 113 which is integral with the upper bracket, the cam follower having a biasing spring 114.

Just as in the case of earlier embodiment, the wiper arms 101, 102 are provided with friction shoes for engagement of the presented lower and upper faces of the sheet. As in the earlier embodiment mounting means are interposed between the friction shoes and the respective wiping members providing freedom of relative movement of the shoe at right angles to the direction of wiping movement so that the sheet may move against the front stops at the same time that it is being wiped toward the side guide. The shoes are indicated respectively at 121, 122, the shoe 121, on the lower arm, being in the form of a roller which is freely rotatable about a pin 123 extending in the direction of wipe.

Figure 5:
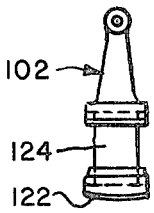
FIGS. 5 and 6 are two views of the upper wiping member employed in the construction of FIG. 4.
Figure 6:
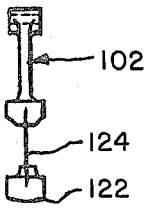

However, and in accordance with one of the more detailed aspects of the invention, the friction shoe 122 is mounted upon a spring 124 which is so constructed and oriented as to provide stiffness in the wiping direction but only a light resilient force in the longitudinal direction of the sheet, a force that is so low as to be readily overcome by movement of the sheet as the sheet completes its travel against the front stops. Such function is accomplished by means of a spring 124 such as that illustrated in FIGS. 5 and 6, the spring being in the form of a thin resilient blade perpendicular to the sheet and the width dimension of which extends in the direction of wiping movement to provide relative rigidity while the "flat" of the blade faces in the direction of sheet movement.

At the beginning of a typical cycle of operation, both the wiper arms 101, 102 occupy their left-most positions, the arm 101 by reason of the cam 103 and the arm 102 by reason of the compression spring 107 forcing the associated arm against the fixed stop 108. The upper bracket is rocked slightly in the clockwise direction so that the shoes 121, 122 do not forcibly bear against the sheet.

However, as the sheet is fed along the table and approaches the front stops, rotation of cam 111 by the drive shaft 105 rocks the upper bracket 92 counterclockwise, lowering the upper wiper arm and the shoe thereon, into engagement with the lower wiper arm, thereby capturing the sheet between them. Continued rotation of the shaft 105 and cam 103 causes the cam follower 104 to reach the point of drop-off so that the lower wiper arm 101 is pulled to the right, in a wiping direction, by the tension spring 106. Because of the friction engagement of the shoe 122 on the upper wiper arm with the top surface of the sheet, such wiper arm moves in unison with the lower arm during the execution of wiping movement. However, it is to be noted that, during the course of wiping movement, the free rotation of the roller 121 and the light force presented by the spring 124 combine to permit the sheet to complete its movement against the front stops during the time that wiping movement is underway. The result is that the sheet is deposited in a precise registered position, more or less simultaneously, against the front stops and against the side guide.

After the wiping stroke has been completed, continued rotation of the drive shaft 105 causes the cam follower 112 to reach a region of drop-off on the cam 111 so that the upper bracket 92 is swung slightly in the clockwise direction under the urging of the spring 114. This swinging movement has an upward component which causes the upper arm 102 to move upwardly away from the lower arm 101. Such relative movement releases the force on the sheet and hence releases the shoe 122 so that the arm 102 can return, under the urging of the spring 107, to its initial position against the stop 108. At the same time, the lower arm 101 undergoes idle return movement to the left by reason of the cam 103 and in readiness for a new operating stroke.

With the sequence of operation of the mechanism in mind, it is in matter well within the skill of the art to contour the cams 103, 111 in accordance therewith.

What we claim is:

1. In a device for the lateral and longitudinal positioning of sheets on the feed table of a sheet-fed printing press, the combination comprising front stops cyclically interposeable at the front of the table, a side guide at the lateral edge of the table, a lower laterally movable wiper member under the sheet in the vicinity of the side guide, an upper laterally moveable wiper member in a cooperating position above the sheet, driving means timed with the arrival of a sheet for imparting wiping movement to the wiper members from a mutually sheet-engaging position spaced from the side guide to a mutually sheet-releasing position adjacent the side guide, the wiping members having respective friction shoes for engagement of the presented lower and upper surfaces of the sheet, the friction shoes being in the form of rollers freely rotatable about axes which extend in the direction of wiping movement so that the sheet may move against the front stops, with accommodating rotation of the rollers, at the same time that the sheet is being wiped by the rollers toward the side guide.

2. In a device for the lateral and longitudinal positioning of sheets on the feed table of a sheet-fed printing press, the combination comprising front stops cyclically interposeable at the front of the table, a side guide at the lateral edge of the table, a lower wiper member including an upper arm in cooperating position above the sheet and mounted for rotation about an axis which extends longitudinally of the table, an upper wiper member including an upper arm in cooperating position above the sheet and mounted for rotation about an axis which lies in substantially the same vertical plane as the first-mentioned axis, means for driving said arms in synchronism for a simultaneous engagement of the sheet for imparting wiping movement to the sheet in the direction of the side guide, the driving means being phased so that the arms engage the sheet as the sheet moves longitudinally along the table into the vicinity of the front stops, the arms having rollers interposed at the ends thereof freely rotatable about axes which extend in the direction of wiping movement so that the sheet may complete its movement against the front stops with accommodating rotation of the rollers at the same time as it is being wiped by the rollers toward the side guide.

3. The combination as claimed in claim 2 in which each wiper member has a pair of diametrically arranged substantially identical arms carrying identically positioned rollers at the ends thereof.

4. The combination as claimed in claim 2 in which the arms are supported for rotation on respective brackets which extend inwardly from the lateral edge of the table, the brackets being supported upon a vertical frame which is mounted outboard of the table adjacent the side guide.

5. The combination as claimed in claim 4 in which at least one of the brackets is vertically swingable and which means are provided for adjusting the spacing between the brackets thereby to adjust the force of wiping engagement of the rollers with the sheet.

6. The combination as claimed in claim 4 in which drive shafts are provided at the inner enter ends of the brackets, the drive shafts being coupled to the arms by respective sprockets and sprocket chains, the drive shafts having respective gears in mesh with one another for maintaining synchronism between the swinging movements of the arms.

7. In a device for the lateral and longitudinal positioning of sheets on the feed table of a sheet-fed printing press, the combination comprising front stops cyclically interposeable at the front of the table, a side guide at the lateral edge of the table, a lower laterally swingable wiper member under the sheet in the vicinity of the side guide, an upper laterally swingable wiper member in a cooperating position above the sheet, driving means timed with the arrival of a sheet for imparting wiping movement to the wiper members from a mutually sheet-engaging position spaced from the side guide to a mutually sheet-releasing position adjacent the side guide, the wiper members having respective friction shoes for engagement of the presented lower and upper surfaces of the sheet, mounting means interposed between the friction shoes and the respective wiper members providing freedom of movement of the friction shoes at right angles to the direction of wiping movement so that the sheet may move against the front stops at the same time that it is being wiped toward the side guide.

8. The combination as claimed in claim 7 in which at least one of the friction shoes is in the form of a freely rotatable roller of crowned contour rotatable about an axis extending in the direction of wiping movement.

9. The combination as claimed in claim 7 in which the friction shoes are both in the form of freely rotatable rollers rotatable about axes which extend in the direction of wiping movement.

10. The combination as claimed in claim 7 in which the mounting means for at least one of the friction shoes includes a spring having its spring force oriented in the longitudinal direction of movement of the sheet, the spring force being sufficiently light as to be readily overcome by the final movement of the sheet against the front stops.

11. The combination as claimed in claim 7 in which at least one of the friction shoes is mounted upon a thin spring blade which lies in a transverse plane which is perpendicular to the plane of the sheet to exhibit stiffness in the wiping direction while permitting freedom of relative movement of the sheet in a direction at right angles thereto.

12. The combination is claimed in claim 7 in which the wiper members are mounted for swinging movement and swung in unison with one another in the wiping direction.

13. The combination as claimed in claim 12 in which the wiper members are mounted upon substantially parallel shafts rotated in unison continuously in opposite directions.

14. The combination as claimed in claim 13 in which each of the wiper members has a plurality of friction shoes and with means for rotating the wiper members in synchronism to bring pairs of the shoes in succession into cooperating wiping relationship.

15. The combination as claimed in claim 7 in which at least one of the wiper members is directly oscillated by the driving means.

16. The combination as claiimed in claim 7 in which both of the wiper members are oscillated in unison by the driving means.

17. The combination as claimed in claim 7 in which one of the wiper members is directly oscillated by the driving means and the other is oscillated by frictional engagement with the sheet, and cyclically operated means coupled to the driving means to bring the wiper members relatively toward one another for wiping engagement of the sheet.

18. In a device for the lateral and longitudinal positioning of sheets on the feed table of a sheet-fed printing press, the combination comprising front stops interposeable at the front of the table, a side guide at the lateral edge of the table, a frame, a lower wiper member including a lower arm rotatable about an axis which extends longitudinally of the table, an upper wiper member including an upper arm in cooperating position above the sheet and rotatable about an axis which lies in substantially the same vertical plane as the first-mentioned axis, lower and upper brackets for respectively mounting the arms, means for driving the arms in synchronism for simultaneous engagement of the sheet for imparting wiping movement to the sheet in the direction of the side guide, the driving means being phased so that the arms engage the sheet as the sheet moves longitudinally along the table into the vicinity of the front stops, the arms having rollers at the ends thereof freely rotatable about axes which extend in the direction of wiping movement so that the sheet may complete its movement against the front stops, with accommodating rotation of the rollers, at the same time that it is being wiped by the rollers toward the side guide, at least one of the brackets being adjustable in vertical position with respect to the frame to accommodate different thicknesses of sheet, and at least one of the brackets having resilient means for holding it in relatively adjusted position to permit relative yielding of the arms as the arms come into dead center position.

* * * * *